US010056022B2

(12) United States Patent
Bonnier et al.

(10) Patent No.: US 10,056,022 B2
(45) Date of Patent: Aug. 21, 2018

(54) SATURATION DEPENDENT IMAGE SPLITTING FOR HIGH DYNAMIC RANGE DISPLAYS

(71) Applicant: Apple Inc., Cupertino, CA (US)

(72) Inventors: Nicolas P. Bonnier, Campbell, CA (US); William M. Riedel, San Francisco, CA (US)

(73) Assignee: Apple Inc., Cupertino, CA (US)

( * ) Notice: Subject to any disclaimer, the term of this patent is extended or adjusted under 35 U.S.C. 154(b) by 75 days.

(21) Appl. No.: 15/179,811

(22) Filed: Jun. 10, 2016

(65) Prior Publication Data

US 2017/0358253 A1 Dec. 14, 2017

(51) Int. Cl.

| | |
|---|---|
| ***G09G 3/20*** | (2006.01) |
| ***G09G 3/36*** | (2006.01) |
| *G09G 3/34* | (2006.01) |
| *G09G 5/02* | (2006.01) |

(52) U.S. Cl.

CPC ..... *G09G 3/2003* (2013.01); *G09G 3/3607* (2013.01); *G09G 3/3413* (2013.01); *G09G 5/028* (2013.01); *G09G 2300/023* (2013.01); *G09G 2300/0456* (2013.01); *G09G 2320/0238* (2013.01); *G09G 2320/0666* (2013.01); *G09G 2340/06* (2013.01)

(58) Field of Classification Search

CPC ..... G09G 3/2003; G09G 3/2007; G09G 2320/0666

See application file for complete search history.

(56) References Cited

U.S. PATENT DOCUMENTS

| | | | | |
|---|---|---|---|---|
| 8,009,158 | B2 | 8/2011 | Chen | |
| 8,482,698 | B2 | 7/2013 | Atkins | |
| 8,860,718 | B2 | 10/2014 | Muijs | |
| 9,135,864 | B2 | 9/2015 | Shields | |
| 9,324,250 | B2 | 4/2016 | Basler | |
| 2009/0167670 | A1* | 7/2009 | Peng | G09G 3/3426 345/102 |
| 2015/0138250 | A1 | 5/2015 | Atkins | |
| 2015/0198834 | A1 | 7/2015 | Wu | |
| 2015/0348506 | A1* | 12/2015 | Ooga | G09G 5/10 345/205 |

OTHER PUBLICATIONS

Guarnieri, et al., "Image splitting techniques for a dual layer high dynamic range LCD display," J. Electron. Imaging. 17(4) 043009, Oct. 1, 2008, DOI: 10.1117/1.3010884.

(Continued)

*Primary Examiner* — Antonio A Caschera

(74) *Attorney, Agent, or Firm* — Blank Rome LLP

(57) ABSTRACT

Systems, methods, and computer readable media that improve the gamut size for a multi-layer display. Various embodiments receive a color input value indicative of a target display color associated with an input image and determine a color saturation value for the received color input value. Based on the color saturation value, a drive value for a monochromatic modulation panel and a drive value for a color modulation panel may be determined. The various embodiments can then drive the monochromatic and color modulation panel according to the drive values. The monochromatic modulation panel is not modulated until the color modulation panel is driven to full illumination.

20 Claims, 10 Drawing Sheets

(56) References Cited

OTHER PUBLICATIONS

Guarnieri, et al., "Minimum-Error Splitting Algorithm for a Dual Layer LCD Display—Part I: Background and Theory," Journal of Display Technology, vol. 4, No. 4, Dec. 2008.
Guarnieri, et al., "Minimum-Error Splitting Algorithm for a Dual Layer LCD Display—Part II: Implementation and Results," Journal of Display Technology, vol. 4, No. 4, Dec. 2008.
Luka, et al., "Colorimetric Image Splitting for High-Dynamic-Range Displays," Society for Information Display Symposium Digest of Technical Papers, vol. 40, Issue 1, pp. 1298-1301, Jun. 2009.
Wanat, et al., "Physical and perceptual limitations of a projector-based high dynamic range display," EG UK Theory and Practice of Computer Graphics (2012).
Zhang, Dan, "Appearance-based image splitting for HDR display systems," A Thesis submitted in partial fulfillment of the requirements for the degree of Master of Science in Color Science in the Center for Imaging Science, Rochester Institute of Technology, Apr. 1, 2011.
Zhang, et al., "Appearance-based Image Splitting for HDR Displays," IS&T/SID, 18th Color Imaging Conference, San Antonio, Texas, United States (2010).

* cited by examiner

SATURATION DEPENDENT IMAGE SPLITTING FOR HIGH DYNAMIC RANGE DISPLAYS

BACKGROUND

This disclosure relates generally to reproducing images on electronic display devices. More particularly, but not by way of limitation, this disclosure relates to reproducing images on high dynamic range (HDR) electronic display devices that are often connected to and/or integrated within a variety of electronic devices that include, but are not limited to mobile phones, tablet computer systems, laptop computer systems, televisions, and display monitors.

Today's electronic display devices are typically connected to and/or embedded within a wide variety of electronic applications, such as computer monitors, televisions, instrument panels, signage, gaming devices, clocks, watches, and mobile electronic devices. One common type of electronic display device is a liquid crystal display (LCD) that typically displays visual images to a viewer by modulating the intensity of light emitted from a light source. Although the use of LCDs continues to spread in popularity, LCDs, however, suffer from to a variety of technological challenges. For instance, a typical single panel LCD may have a limited dynamic range (e.g., about 1000:1) that adversely affects a viewer's perceived image quality when viewing images on the LCD. In particular, the single panel LCD may suffer from a reduction in the number of gray levels the LCD is able to reproduce and may also impair the visibility of dark areas of an image.

One approach to improve a LCD's dynamic range is to implement a dual layer LCD. A dual layer LCD is able to improve the black level of an LCD by stacking two liquid crystal panels in a series configuration. In comparison to a single panel LCD, a dual layer LCD is able to produce a more accurate grayscale by modulating the light from a light source twice. Even though dual layer LCDs improve an electronic display device's grayscale, dual layer LCDs may also experience other implementation and technological challenges. For instance, the distances from the two liquid crystal panels can cause parallax problems when a viewer observes the LCD off-axis. Additionally, while a dual layer LCD permits darker black colors, the dual layer LCD may be unable to display a wide variety of other saturated dark colors (e.g., non-black dark colors) in a display's color gamut. As such, improving the gamut size and minimizing parallax errors may be beneficial in enhancing a viewer's perceived image quality when displaying images on electronic display devices.

SUMMARY

In one embodiment, the disclosed subject matter provides a method to improve gamut size for a multi-layer display device. The method includes receiving a color input value indicative of a target display color associated with an input image. The method may then determine a color saturation value for the received color input value. The color saturation values may be used to compute drive values for a monochromatic modulation panel and a color modulation panel. Afterwards, the monochromatic modulation panel and the color modulation panel may be illuminated based on the drive values. The method drives the monochromatic modulation panel and the color modulation panel such that the monochromatic modulation panel is not modulated until the color modulation panel is fully illuminated.

In another embodiment, the method improves gamut size for a multi-layer display device by minimizing the modulation of the color modulation panel and maximizing modulation of the monochromatic modulation panel. A method in accordance with this approach includes receiving a color input value indicative of a target display color associated with an input image at a per-pixel or per-panel element basis. The method may then determine a color saturation value for the received color input value and compute a monochromatic drive value that is a linear weighted sum of color saturation value. The monochromatic modulation panel may be driven by the monochromatic drive value, where the monochromatic modulation panel is not modulated until the color modulation panel is fully illuminated. To minimize parallax issues, the method may also apply a radial distortion to an image generated from the monochromatic modulation panel.

In yet another embodiment, the method reproduces dark saturated colors and reduces parallax artifacts on a dual layer LCD. This approach involves using a neutral back liquid crystal panel to lower luminance and a front liquid crystal panel to produce color. The back liquid crystal panel may serve as a monochromatic light shutter that modulates light to produce a gray scale. The front liquid crystal panel may serve as a chroma light shutter with a relatively higher resolution than the back liquid crystal panel. To expand the available gamut, the dual layer LCD may minimize the use of the front liquid crystal panel while maximizing the use of the back liquid crystal panel by determining a saturation value to drive both the back liquid crystal panel and the front liquid crystal panel. To reduce halos or parallax experienced by a viewer, a radial distortion may be applied to a back panel image to align the back liquid crystal panel and the front liquid crystal panel local with respect to a viewer's view point.

In one or more embodiments, each of the above described methods, and variation thereof, may be implemented as a series of computer executable instructions. Such instructions may use any one or more convenient programming language. Such instructions may be collected into modules and/or programs and stored in any media that is readable and executable by a computer system or other programmable control device.

DETAILED DESCRIPTION

Figure 1:
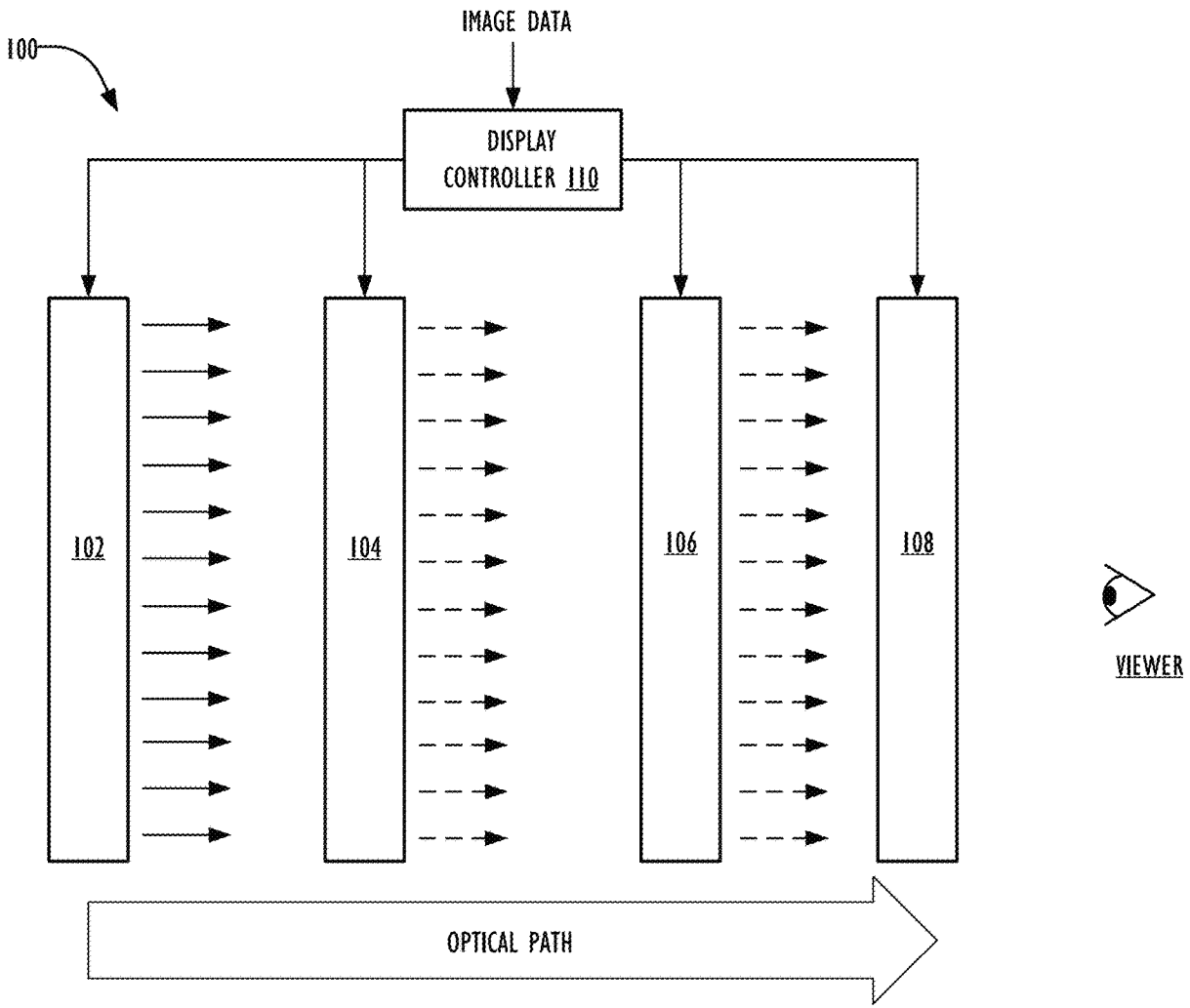
FIG. 1 is a block diagram of a multi-layer display system wherein embodiments of the present disclosure may operate.

This disclosure includes various example embodiments that reproduce dark saturated colors and minimizes parallax problems associated with image splitting for electronic display devices. In one embodiment, a dual layer liquid crystal display (LCD) reproduces dark, non-black, saturated colors (e.g., dark red, blue, and/or green) using a neutral back liquid crystal panel to lower luminance and a front liquid crystal panel to produce color. The back liquid crystal panel may serve as a monochromatic light shutter that modulates light to produce a gray scale. The front liquid crystal panel may serve as a chroma light shutter with a relatively higher resolution than the back liquid crystal panel. Based on the color of an input image, the dual layer LCD may determine how much to drive the two different liquid crystal panels. The dual layer LCD may drive the front liquid crystal panel and the back liquid crystal panel on a per pixel basis and/or a per back liquid crystal panel element when the back liquid crystal panel and the front liquid crystal panel do not have the same resolution. To expand the available gamut, the dual layer LCD may minimize the use of the front liquid crystal panel while maximizing the use of the back liquid crystal panel. Additionally, to reduce halos or parallax experienced by a viewer, a radial distortion may be applied to the back panel image to align the back panel and the front panel with respect to a viewer's view point.

In the following description, for purposes of explanation, numerous specific details are set forth in order to provide a thorough understanding of the inventive concept. As part of this description, some of this disclosure's drawings represent structures and devices in block diagram form in order to avoid obscuring the invention. In the interest of clarity, not all features of an actual implementation are described. Moreover, the language used in this disclosure has been principally selected for readability and instructional purposes, and may not have been selected to delineate or circumscribe the inventive subject matter, resort to the claims being necessary to determine such inventive subject matter. Reference in this disclosure to "one embodiment" or to "an embodiment" means that a particular feature, structure, or characteristic described in connection with the embodiment is included in at least one embodiment of the invention, and multiple references to "one embodiment" or "an embodiment" should not be understood as necessarily all referring to the same embodiment.

It will be appreciated that in the development of any actual implementation (as in any development project), numerous decisions must be made to achieve the developers' specific goals (e.g., compliance with system- and business-related constraints), and that these goals may vary from one implementation to another. It will also be appreciated that such development efforts might be complex and time-consuming, but would nevertheless be a routine undertaking for those of ordinary skill in the design and implementation of detecting motion having the benefit of this disclosure.

FIG. 1 is a block diagram of a multi-layer display system 100 wherein embodiments of the present disclosure may operate. The multi-layer display system 100 may be configured to receive a red-green-blue (RGB) image (e.g., an HDR or standard dynamic range (SDR) image) and/or a sequence of images (e.g., video) as input and subsequently reproduce the image and/or the sequence of images to a viewer. FIG. 1 illustrates that the multi-layer display system 100 may include a light source and diffuser 102, a back modulation panel 104, a front modulation panel 106, a color filter layer 108, and a display controller 110. In order to reproduce one or more images to a viewer, the multi-layer display system 100 creates an optical path that modulates light intensity using at least two different light modulation stages. As shown in FIG. 1, to modulate light at least twice, the light source and diffuser 102 may emit light along an optical path that includes a back modulation panel 104 and a front modulation panel 106 to reach a viewer. Light that travels along the optical path first reaches the back modulation panel 104 to perform a first stage light modulation. After the back modulation panel 104 performs the first stage light modulation, the optical path then provides the modulated light to the front modulation panel 106 to perform a second stage light modulation. The display controller 110 may adjust the amount of modulation for the back modulation panel 104 and/or the front modulation panel 106 according to image data corresponding to one or more digital images.

The light source and diffuser 102 may include a backlight unit that emits light that travels along the optical path in a direction towards the color filter layer 108. The light from the backlight unit may illuminate images that the back modulation panel 104 and the front modulation panel 106 produce for the viewer. By way of example, the backlight unit may be a direct light source type located directly behind the back modulation panel 104 or an edge light source type located at the edges of a screen. The backlight unit may include light emitters, such as cathode fluorescent lamps, light emitting diodes (LEDs) (e.g., a row or full array of white LEDs) organic LEDs (e.g., RGB LEDs)), quantum dot structures, solid state lasers, and/or any other known type of light source that emits lights for electronic display devices. The light source and diffuser 102 may also include one or more diffuser layers that scatter the light from the backlight unit and assist in homogenizing light that the backlight unit emits in order to reduce hotspots.

In one embodiment, light source and diffuser 102 may generate light from a backlight unit using quantum dots. The quantum dots may have a spectrum with wavelength peaks that align with the colors corresponding to the color filter elements in the color filter layer 108. The backlight unit of the light source and diffuser 102 may include a light source and a quantum dot structure. The light source may include one or more blue light-emitting diodes that produce blue light. The quantum dot structure receives the blue light from the light source and outputs corresponding light at wavelengths associated with the R, G, and B color filter elements in the color filter layer 108. The diffuser, which may be interchangeable and also referred to within this disclosure as "a light guide plate," may distribute and scatter the light emitted from the backlight unit into the optical path. By doing so, the diffuser is able to evenly distribute light that travel along the optical path.

The back modulation panel 104 may modulate the intensity of the backlight received in the optical path in order to display pixels of varying shades of gray that range from black to white. The back modulation panel 104 may be generally referred to as a monochromatic stage, shutter stage, and/or a localized dimming stage that enhances the dynamic range of the multi-layer display system 100. For example, the back modulation panel 104 may provide a local dimming effect for the dark areas of a projected image. The local dimming effect delivers additional darkening of pixels in dark areas generated with the front modulation panel 106. As a monochromatic stage, the back modulation panel 104 may be configured to not impart color information to a viewer, and may not include a color filter layer and/or other types of color filter elements.

The front modulation panel 106 may be referred to as a color stage with pixels that create color images. As shown in FIG. 1, the multi-layer display system 100 may include a color filter layer 108 coupled to the front modulation panel 106 to display pixels for a color image. In other embodiments, the color filter layer 108 may be part of the front modulation panel 106. The color filter layer 108 may contain an array of color filter elements that are associated with a corresponding pixel in the front modulation panel 106. For example, each pixel of the front modulation panel 106 may pass light through to corresponding red (R), green (G), and blue (B) filter elements to generate a specific color for each pixel. Specifically, each of the front modulation panel's 106 pixels may have an R, G, and B filter element that are each individually addressable. The R filter element may provide a red light component of an input image corresponding to one of the front modulation panel's 106 pixels, the G filter element may provide a green light component of the input image for the same front modulation panel's 106 pixel, and the B filter element may provide a blue light component of the input image for the same front modulation panel's 106 pixel. To reduce color filter layer transmission loss, the color filter layer 108 may also include white color filter elements that pass backlight without significant transmission losses from light filtering.

In one embodiment, the back modulation panel 104 and the front modulation panel 106 may each include a liquid crystal layer, such as an active matrix liquid crystal layer, a trans-reflective liquid crystal layer, and/or window liquid crystal layer, to modulate the intensity of light, which can be measured in terms of transmittance and/or luminance. The liquid crystal layer may comprise liquid crystals (e.g., twisted nematic) that orient and twist based on applying varying levels of current to the liquid crystal layer. For example, electric power that supplies current to the liquid crystal layer may cause one or more of the liquid crystals to untwist and orient themselves to block light from passing through. In areas where the liquid crystal layer allows for light that passes through, the orientation of the liquid crystals cause the passing light to rotate or change polarization. The back modulation panel 104 and the front modulation panel 106 may each include one or more polarizer layers. For example, the back modulation panel 104 may include a polarizer layer positioned between the liquid crystal layer and the light source and diffuser 102 and a second polarizer layer positioned between the liquid crystal layer and the front modulation panel 106.

In one embodiment, the back modulation panel 104 may be set to have a relatively lower pixel resolution than the front modulation panel 106. For example, the front modulation panel 106 may be set to produce an overall display resolution desired for the multi-layer display system 100 while the back modulation panel 104 may be set to produce a resolution less than overall display resolution. In embodiments where the back modulation panel 104 has a lower pixel resolution than the front modulation panel 106, the back modulation panel 104 may include arrays of local dimming elements that have a pixel-to-pixel spacing, which may also be referred to as "pixel pitch," greater than the pixel-to-pixel spacing of the front modulation panel 106. By doing so, each of the local dimming elements may overlap and correspond to multiple higher-resolution pixels of the front modulation panel 106. For example, each local dimming element of the back modulation panel 104 may overlap a 2×2 subarray of higher-resolution pixels within the front modulation panel 106. In this instance, the back modulation panel 104 may perform local dimming operations for a set of four higher-resolution pixels of the front modulation panel 106. Other embodiments of the multi-layer display system 100 may differ in the number of higher-resolution pixels of the front modulation panel 106 that overlap and correspond to the local dimming pixels of the back modulation panel 104.

As show in FIG. 1, a display controller 110 may receive and process input image data for one or more digital images. In one embodiment, the display controller 110 may receive an 8 bit image data encoded in standard RGB (sRGB) format. Once receiving the image data, the display controller 110 may transform the image data that is encoded in RGB format to image data that is encoded in white-RGB (WRGB) format. To reproduce the digital images, the display controller 110 may generate control signals based on the input image data and provide control signals to the light source and diffuser 102 (e.g., driver circuit for the backlight), the back modulation panel 104, and/or the front modulation panel 106. The display controller 110 may also perform a variety of other image processing steps that include, but are not limited to color gamut mapping algorithms, subpixel rendering algorithms, and/or linearization of the input image data. Additionally, the display controller 110 may perform image splitting operations in which the display controller 110 provides control signals for different aspects of the received image data to the back modulation panel 104, and/or the front modulation panel 106. Examples of image splitting operations that are known in the art include square root image splitting, full color image splitting, appearance-based image splitting, and model-based image splitting.

When performing image splitting operations on input image data, the multi-layer display system 100 may generate at least two coupled images, one for the back modulation panel 104 and another for the front modulation panel 106. Specifically, the multi-layer display system 100 may split and process a given input image (e.g., HDR input image) into two complimentary images, where one of the images is sent as monochromatic data and the second image is sent as color data. The display controller 110 may activate the back modulation panel 104 based on the monochromatic data and activate the front modulation panel 106 based on the color data. The multi-layer display system 100 is able to accurately reproduce the input image data to a viewer by combining the two coupled images.

In one embodiment, rather than performing a square root image splitting algorithm that splits transmission of the back modulation panel 104 and the front modulation panel 106 evenly, the display controller 110 may perform an image split operation that minimizes the use of the back modulation panel 104 and relies on driving the front modulation panel 106 to avoid parallax artifacts. In particular, the display controller 110 may not leverage the back modulation panel 104 to generate neutral colors or bright colors. Neutral colors are colors that have low saturation levels that are below 0.1. Instead, the display controller 110 may use the back modulation panel 104 in situations to achieve a darker black color and drive the back modulation panel 104 to reach full illumination before driving the front modulation panel 106 to produce color. In some instances, to improve image splitting operations, a low-pass filter may be applied to the back modulation panel 104 to blur the back panel image in order to avoid parallax artifacts. While this approach improves obtaining darker black colors, the multi-layer display system 100 may be unable to increase its gamut size for other colors (e.g., dark red, dark blue, or dark green).

To improve gamut size, the display controller 110 may perform image splitting operations that activate the back modulation panel 104 to lower luminance and drive the front modulation panel 106 for color. Based on the input image data, display controller 110 may determine how much to drive the back modulation panel 104 and the front modulation panel 106 by minimizing the use of the front modulation panel 106 and maximizing the use of the back modulation panel 104. By leveraging the back modulation panel 104 and fully using the color gamut of the front modulation panel 106, the multi-layer display system 100 may expand the available gamut by reproducing more dark saturated colors other than black (e.g., dark red, dark blue, or dark green).

Although FIG. 1 illustrates a specific embodiment of a multi-layer display system 100 the disclosure is not limited to the specific embodiment illustrated FIG. 1. In one or more embodiments, the back modulation panel 104 may have about the same or higher resolution than the front modulation panel 106. Embodiments of the present disclosure may also be able to implement the monochromatic stage using the front modulation panel 106 and the color stage using the back modulation panel 104. Additionally, although the disclosed multi-layer display system 100 is able to reproduce HDR images, the multi-layer display system 100 is not limited to HDR images and may be applied to reproducing any type of digital image to display to a viewer. Persons of ordinary skill in the art will also be aware that multi-layer display system 100 may comprise a variety of other components not shown in FIG. 1, but are well-known in the art that include, but are not limited to driver circuits (e.g., for the backlight unit, the back modulation panel 104, and the front modulation panel 106), optical films, reflectors, and electrodes.

Other embodiments of the multi-layer display system 100 may include more than two modulation stages and/or implement one or more of the modulation stages without using a LCD panel. In one embodiment, the multi-layer display system 100 may include three modulation stages, a two dimensional (2D) backlight unit, a back modulation panel 104, and a front modulation panel 106. The 2D backlight unit may be a matrix of LEDs that are locally dimmed to reduce power and the back modulation panel 104 may be selected based on the current 2D LED image. In another embodiment, the multi-layer display system 100 may not include a back modulation panel 104, and instead use the 2D backlight unit to implement local dimming and the front modulation panel 106 for color modulation. The use and discussion of FIG. 1 is only an example to facilitate ease of description and explanation.

Figure 2:
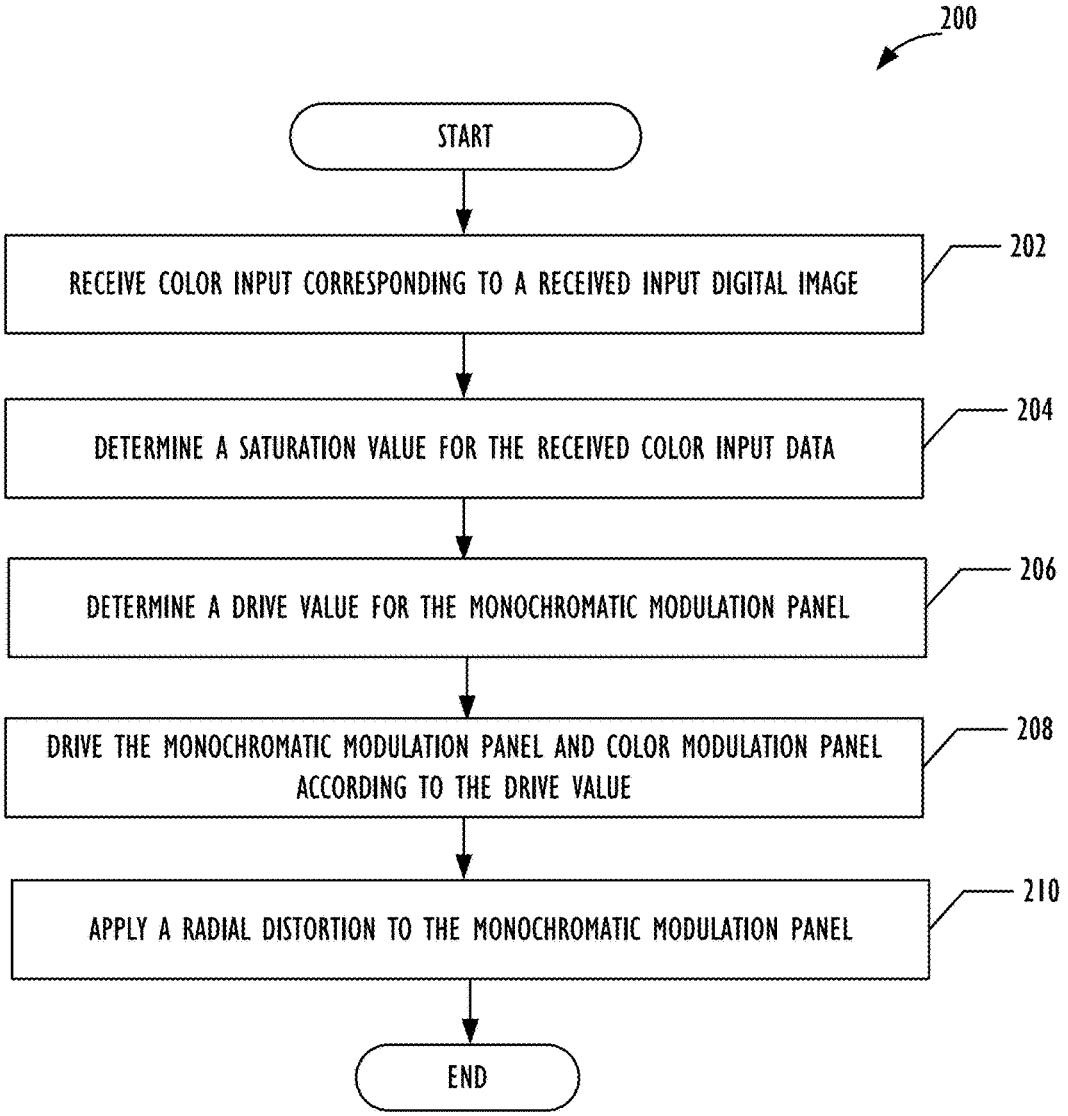
FIG. 2 illustrates an image splitting operation for reproducing an input image in accordance with one embodiment.

FIG. 2 illustrates an image splitting operation 200 for reproducing an input image in accordance with one embodiment. The image splitting operation 200 may be implemented using a dual layer LCD and/or other multi-layer display system that modulates light intensity from a light source at least twice. Using FIG. 1 as an example, the multi-layer display system 100 may be configured to perform image splitting operation 200. In other embodiments, the image splitting operation 200 may be implemented using other image rendering systems, such as a video-graphics card. The image splitting operation 200 may be implemented using different image rendering components depending on whether the multi-layer display system is an embedded electronic display device (e.g., mobile phones, tablets, and/or wearable devices) or externally connected to a computing device (e.g., a computer monitor) and reproduces images based on input image data from the computing device.

Image splitting operation 200 can start at block 202 by receiving color input data corresponding to a received input digital image. Operation 200 may receive the color input data on a per-pixel and/or on a per-panel element basis. In one embodiment, operation 200 may receive color input data on a per-panel element when at least one of the modulation panels has a resolution that differs from the resolution of another modulation panel. For example, a monochromatic modulation panel may be set to a lower resolution than the color modulation panel such that each monochromatic modulation panel element overlaps with four color modulation panel pixels. Operation 200 may receive the color input data on a per-pixel basis, when the modulation panels have about the same resolution. For example, the monochromatic modulation panel may be set to about the same resolution as a color modulation panel such that each monochromatic modulation panel pixel corresponds to one color modulation panel pixel.

Image splitting operation 200 may then move to block 204 and determine a saturation value for the received color input data. Similar to block 202, the image splitting operation 200 may determine the saturation value on a per-pixel or per-panel element basis. In one embodiment, the saturation value for a pixel or panel element may be a defined by the following equation:

$$\text{color delta}/\text{color sum} \tag{1}$$

where color delta represents the difference between the maximum of the three RGB color values and the minimum of the three RGB colors values of the pixels, and the color sum is determined from adding the maximum of the three RGB color values and the minimum of the three RGB colors values of the pixels. In one embodiment, when determining the color delta and color sum, the luminance values of the different pixels may be normalized values. Other embodiments of block 204 may adopt other well-known method of determining saturation. For example, image splitting operation 200 may convert the three RGB color values to the International Commission on Illumination LCH (CIELCH) color space, and then use chroma as saturation.

Image splitting operation 200 may then move to block 206 to determine a drive value for the monochromatic modulation panel. In one embodiment, the image splitting operation 200 determines the drive of the monochromatic modulation panel using a linearly weighted sum determined from the saturation value obtained in block 204. In particular, the drive value for the monochromatic modulation panel may be defined by equation 2:

$$\text{Drive}=(1-\text{SV})(\text{mmp starting point min})+(\text{SV})(\text{mmp_starting_point max}) \tag{2}$$

where "SV" refers to the saturation value determined in block 204, the "mmp starting point min" refers to the maximum drive value to produce the lowest luminance for the monochromatic modulation panel, and the "mmp starting point max" refers to the minimum drive value to produce full luminance for the monochromatic modulation panel. Other embodiments of block 206 may perform other well-known linear and/or non-linear functions using the saturation value to determine a drive value for the monochromatic modulation panel. Examples of this includes replacing SV with SV^n for some power of n or use a piecewise function where if SV is less than a threshold value, then the drive is set to the maximum drive value, and if SV is greater than equal to the threshold value, then the drive is set to a minimum drive value. Basing the drive value on the saturation levels may allow the monochromatic modulation panel to activate in dark regions and maintain color purity in order to obtain dark saturated colors other than black. For input image data that is scaled between 0 and 1000, dark regions are located between the 0-1 range.

The drive level for the color modulation panel may be based on the drive level of the monochromatic modulation level. For example, the image splitting operation 200 may determine the color modulation panel drive value on a pixel-by-pixel that involves a color transformation matrix. The color transformation matrix may be based on a target color in the XYZ space and the monochromatic modulation panel's luminance, which is defined by defined by equation 3:

$$\begin{bmatrix} X_{in} \\ Y_{in} \\ Z_{in} \end{bmatrix} = \left( \begin{bmatrix} X_r & X_g & X_b \\ Y_r & Y_g & Y_b \\ Z_r & Z_g & Z_b \end{bmatrix} \times \begin{bmatrix} R_f \\ G_f \\ B_f \end{bmatrix} + \begin{bmatrix} X_k \\ Y_k \\ Z_k \end{bmatrix} \right) \cdot (L_B(1 - A_k) + A_k) \tag{3}$$

where $[X_{in}, Y_{in}, Z_{in}]$ represents the input or target XYZ signal, $L_B$ represents a linear monochromatic modulation panel luminance and/or transmittance signal, $A_k$ represents the color modulation panel drive value, $[R_f, G_f, B_f]$ represents the color modulation panel drive value, $[X_k, Y_k, Z_k]$ represents the minimum leakage black level for the color modulation panel drive and $$\begin{bmatrix} X_r & X_g & X_b \\ Y_r & Y_g & Y_b \\ Z_r & Z_g & Z_b \end{bmatrix}$$

represents the color transformation matrix. Solving for the color modulation panel drive value, $[R_f, G_f, B_f]$ produces equation 4:

$$\begin{bmatrix} R_f \\ G_f \\ B_f \end{bmatrix} = \begin{bmatrix} X_r & X_g & X_b \\ Y_r & Y_g & Y_b \\ Z_r & Z_g & Z_b \end{bmatrix}^{-1} \times \left( \begin{bmatrix} \frac{X_{in}}{A'} \\ \frac{Y_{in}}{A'} \\ \frac{Z_{in}}{A'} \end{bmatrix} - \begin{bmatrix} X_k \\ Y_k \\ Z_k \end{bmatrix} \right) \tag{4}$$

where A' equals $(L_B(1-A_k)+A_k)$.

Afterwards, the image splitting operation 200 may move to block 208 and drive the monochromatic modulation panel and a color modulation panel according to the drive values. The image splitting operation 200 may directly drive the monochromatic modulation panel using the drive value computed in block 206. To drive the color modulation panel, the image splitting operation 200 may apply a color panel algorithm that uses the drive value found in block 206 to determine a drive value for the color modulation panel, such as equation 4 as shown above.

Image splitting operation 200 may then move to block 210 and apply a radial distortion, such as a radial translation filter, to the monochromatic modulation panel in order to align the images generated from the two modulation panels. Image splitting operation 200 may align the image locally with respect to a viewer's view point. To perform the local alignment, one or more embodiments of the image splitting operation 200 may perform eye-tracker algorithm known by persons or ordinary skill in the art. For example, a gaze tracker operation may utilize a camera to capture an image of the user's eye and an image processing algorithm that analyze the image, extract image features and applies the image features to minimize parallax error. In other words, the gaze tracker operation may locate the position of the user and shift the images on each modulation panel by applying the radial distortion to the monochromatic modulation panel. By tracking a variety of factors associated with the viewer that include, but are not limited to gaze points, pupil size, frequency of blinking, emotional state of the user, and/or position of the user relative to the screen, the images from the modulation panels may be locally aligned with respect to the viewer's view point. In one embodiment eye tracking could employ infra-red light source and/or cameras to track eye movement.

Figure 3:
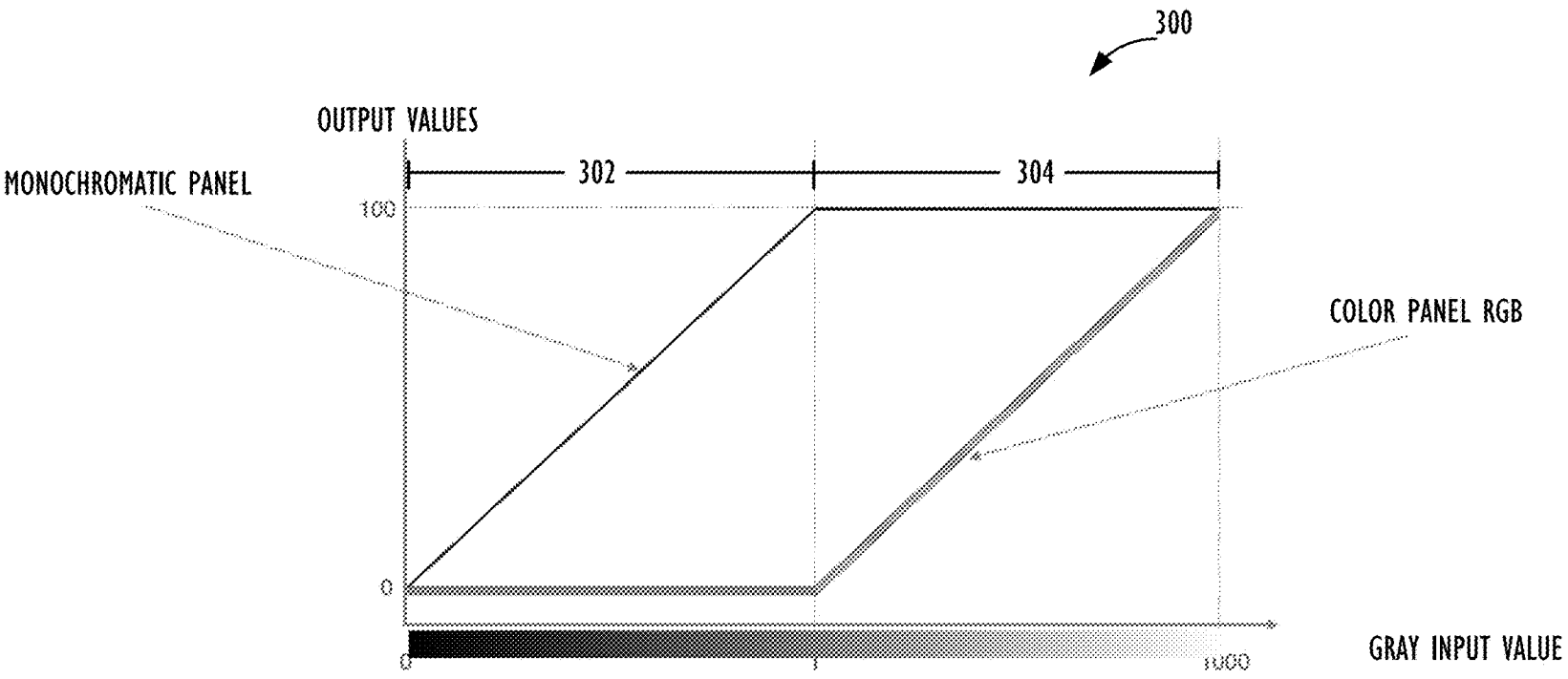
FIG. 3 shows a graphical representation of illuminating two modulation panels to output a grayscale that achieves darker blacks for a pixel or a panel element when minimizing the use of the monochromatic modulation panel.

FIG. 3 provides a graphical representation 300 of illuminating two modulation panels to output a grayscale that achieves darker blacks for a pixel or a panel element when minimizing the use of the monochromatic modulation panel. In FIG. 3, to create the darkest black color, a multi-layer display system may initially not illuminate both the monochromatic modulation panel and the color modulation panel. Section 302 in FIG. 3 represents the region where the multi-layer display system activates the monochromatic modulation panel to generate lighter blacks according to the gray input values. Once the monochromatic modulation panel is fully illuminated at the end of section 302, the multi-layer display system transitions to section 304 and starts to activate the color modulation panel for all three of the RGB colors to reproduce brighter gray input values. Activation of the color modulation panels occurs as the gray input values transition from a black color to shades of gray and white. Section 304 ends when the multi-layer display system fully illuminates the color modulation panel for all three of the RGB colors to create a white color.

Figure 4:
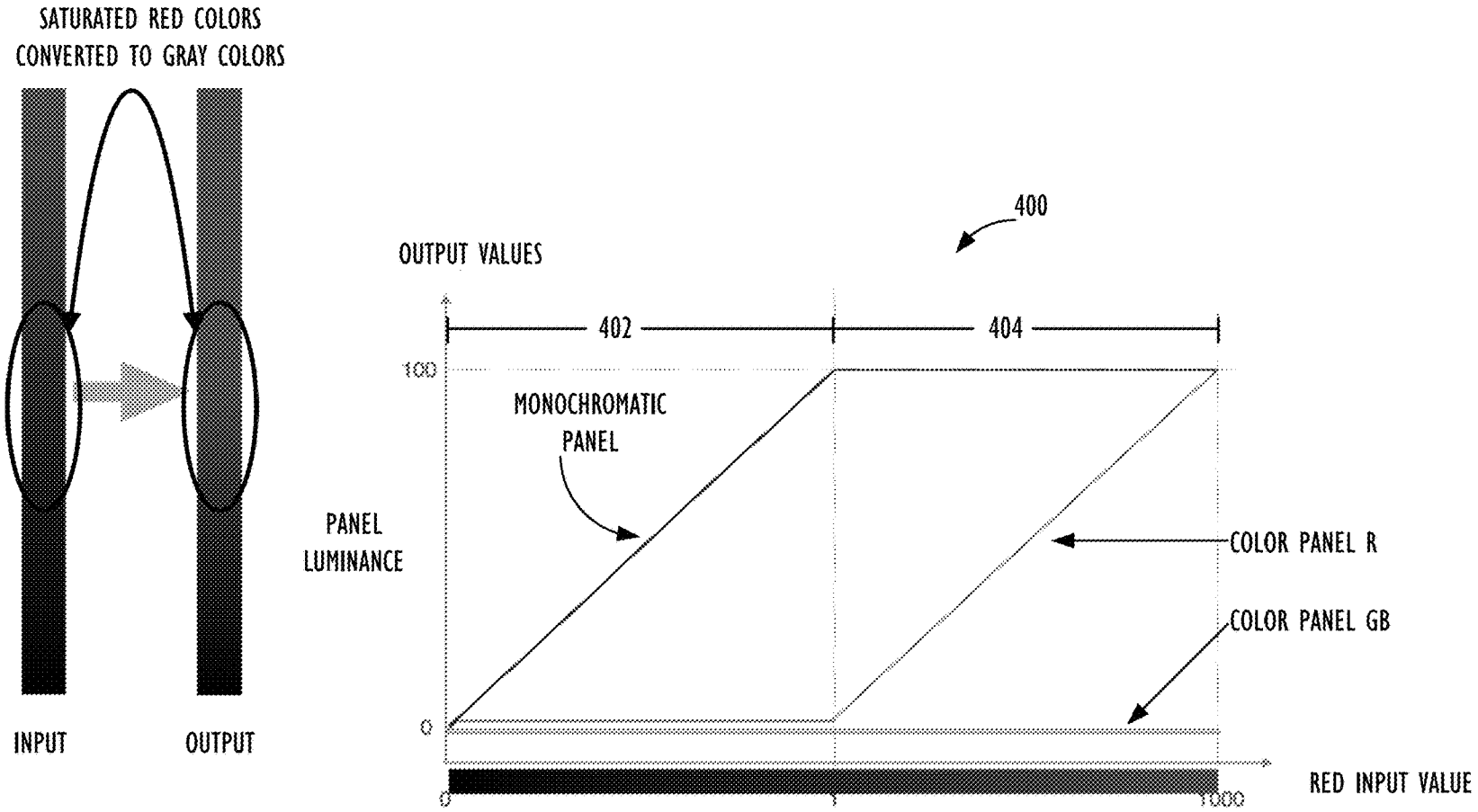
FIG. 4 shows a graphical representation of illuminating two modulation panels to output a red (R) edge for a pixel or a panel element when minimizing the use of the monochromatic modulation panel.

FIG. 4 provides a graphical representation 400 of illuminating two modulation panels to output an R edge for a pixel or a panel element when minimizing the use of the monochromatic modulation panel. Similar to FIG. 3, when the input color is a dark black, a multi-layer display system does not activate both the monochromatic modulation panel and the color modulation panel. As the input color transitions to a darker red tone, the multi-layer display system increases illumination of the monochromatic modulation panel as shown in section 402. Once the monochromatic modulation panel is fully illuminated, the multi-layer display system activates the color modulation panel for the R edge as shown in section 404. The multi-layer display system does not activate the G and B color elements of the color modulation panel since the input colors correspond to different tones of red. As the red color becomes brighter for the input color, the multi-layer display system increases illumination of the color modulation panel. In FIG. 4, when multi-layer display system receives deep saturated reds as the input color value, the multi-layer display system rather than outputting a similar deep saturated red color, outputs a gray color.

Figure 5:
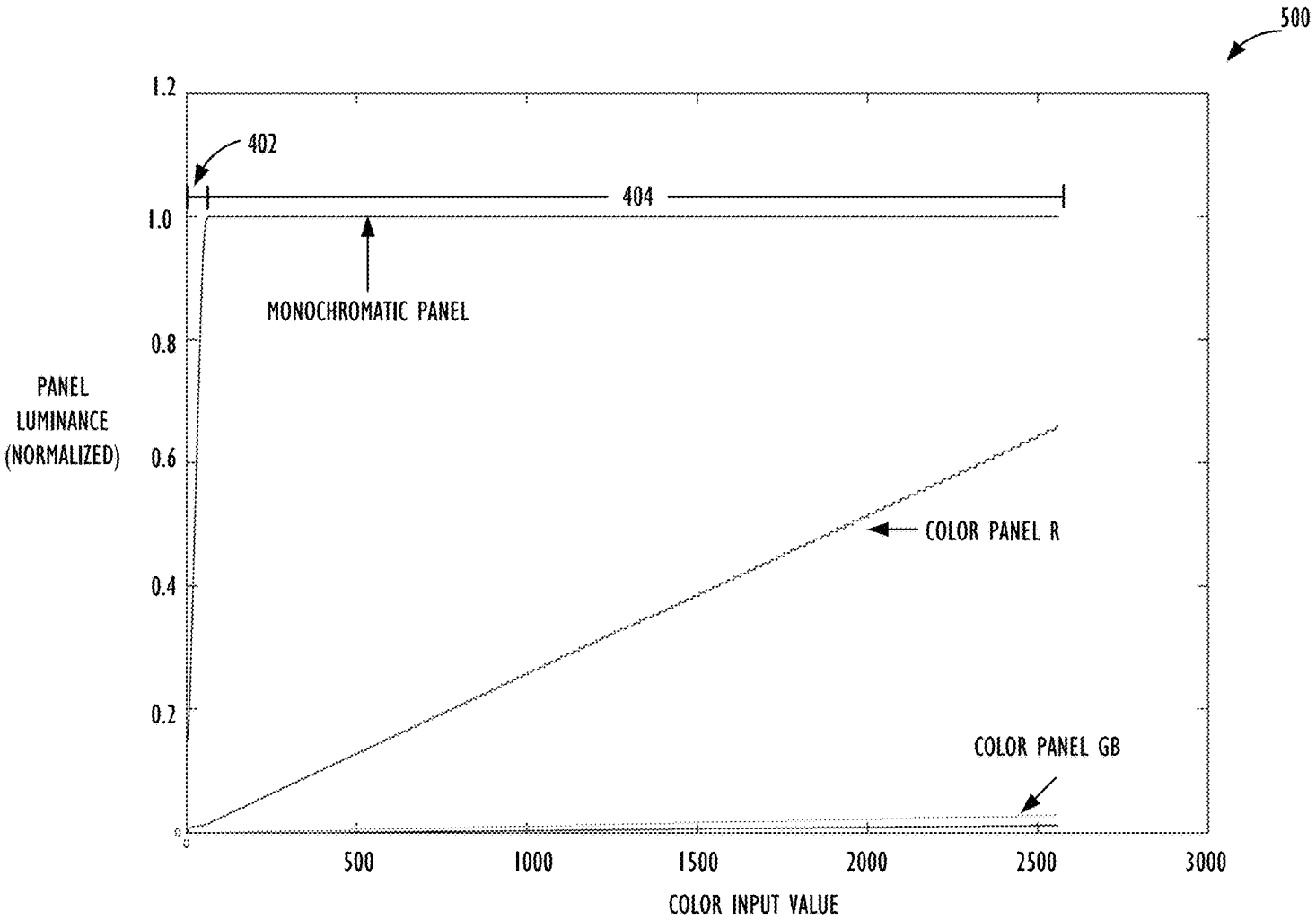
FIG. 5 is an embodiment of a test plot that illustrates minimizing the use of the monochromatic modulation panel and maximizing the use of the color modulation panel.

FIG. 5 is an embodiment of a test plot 500 that illustrates minimizing the use of the monochromatic modulation panel (e.g., section 402) and maximizing the use of the color modulation panel (e.g., section 404). Specifically, the monochromatic modulation panel activates in the dark regions to produce darker blacks, maintain color purity, and minimize parallax artifacts. Although both FIGS. 3 and 4 illustrate that the input gamut sizes for the activation region of the monochromatic modulation panel (e.g., sections 302 and 402) to be approximately the same as the activation region of the color modulation panel (e.g., section 304 and 404), the actual gamut size for the activation region of the monochromatic modulation panel is typically smaller than the activation region of the color modulation panel. FIGS. 3 and 4 are not drawn to scale and are included as example graphical representations to facilitate ease of description and explanation. FIG. 5 provides the test plot 500 that corresponds to the graphical representation 400 illustrated in FIG. 4. As shown in FIG. 5, section 402 corresponds to a smaller gamut size for the color inputs than section 404. By reducing the number of color input values for section 402, the multi-layer display system minimizes the use of the monochromatic modulation panel and maximizes the use of the color modulation panel.

Figure 6:
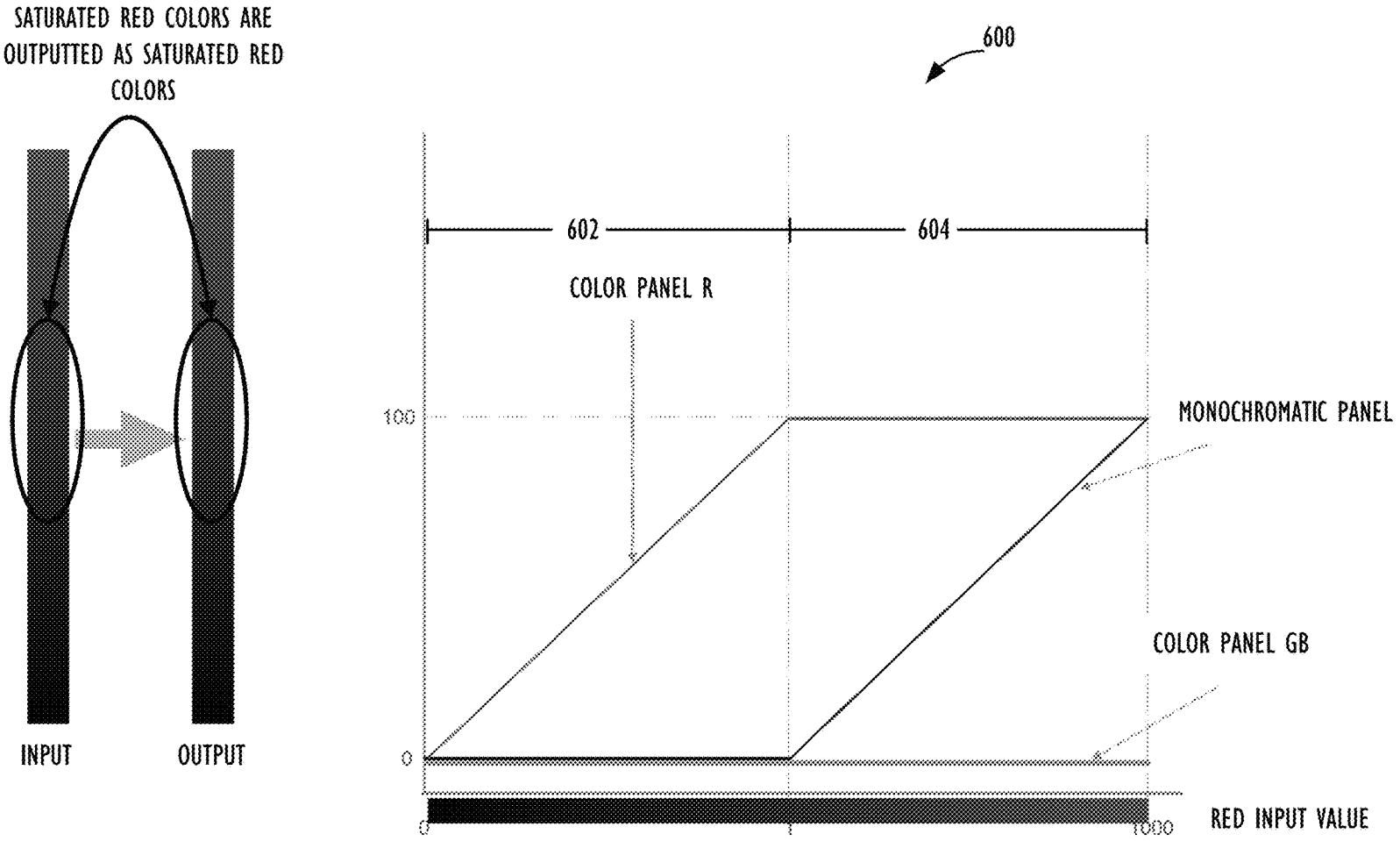
FIG. 6 shows a graphical representation for illuminating two modulation panels that increases gamut size by obtaining darkly saturated colors.

To obtain darkly saturated colors and improve gamut range, the multi-layer display system may maintain a neutral monochromatic modulation panel while activating the color modulation panel. FIG. 6 depicts a graphical representation 600 for illuminating two modulation panels to output an R edge for a pixel or a panel element in order to obtain darkly saturated colors. FIG. 6 illustrates that as the input color moves from a dark black color to a dark red color, the electronic display device does not activate the monochromatic modulation panel as shown in section 602. In contrast to FIG. 4, the multi-layer display system activates the color modulation panel to produce red chroma in the dark regions. Once the color modulation panel is fully illuminated, the multi-layer display system transitions to section 604 and activates the monochromatic modulation panel and illuminates the monochromatic modulation panel based on the red input color in the bright regions. For input image data scaled between 0 and 100, the bright regions may be defined as regions that are above one (e.g., 1-1000 range). As the red input color becomes brighter, the multi-layer display system increases the luminance of the monochromatic modulation panel. Similar to FIGS. 3 and 4, FIG. 6 is not drawn to scale section. Section 602 is relatively shorter than section 604 such that the multi-layer display system minimizes the use of the color modulation panel and maximizing the use of the monochromatic modulation panel in order to obtain darkly saturated colors. The multi-layer display system may generate other darkly saturated colors by activating the B chroma, the G chroma, and/or combination of the RGB chroma of the color modulation panel.

Figure 7:
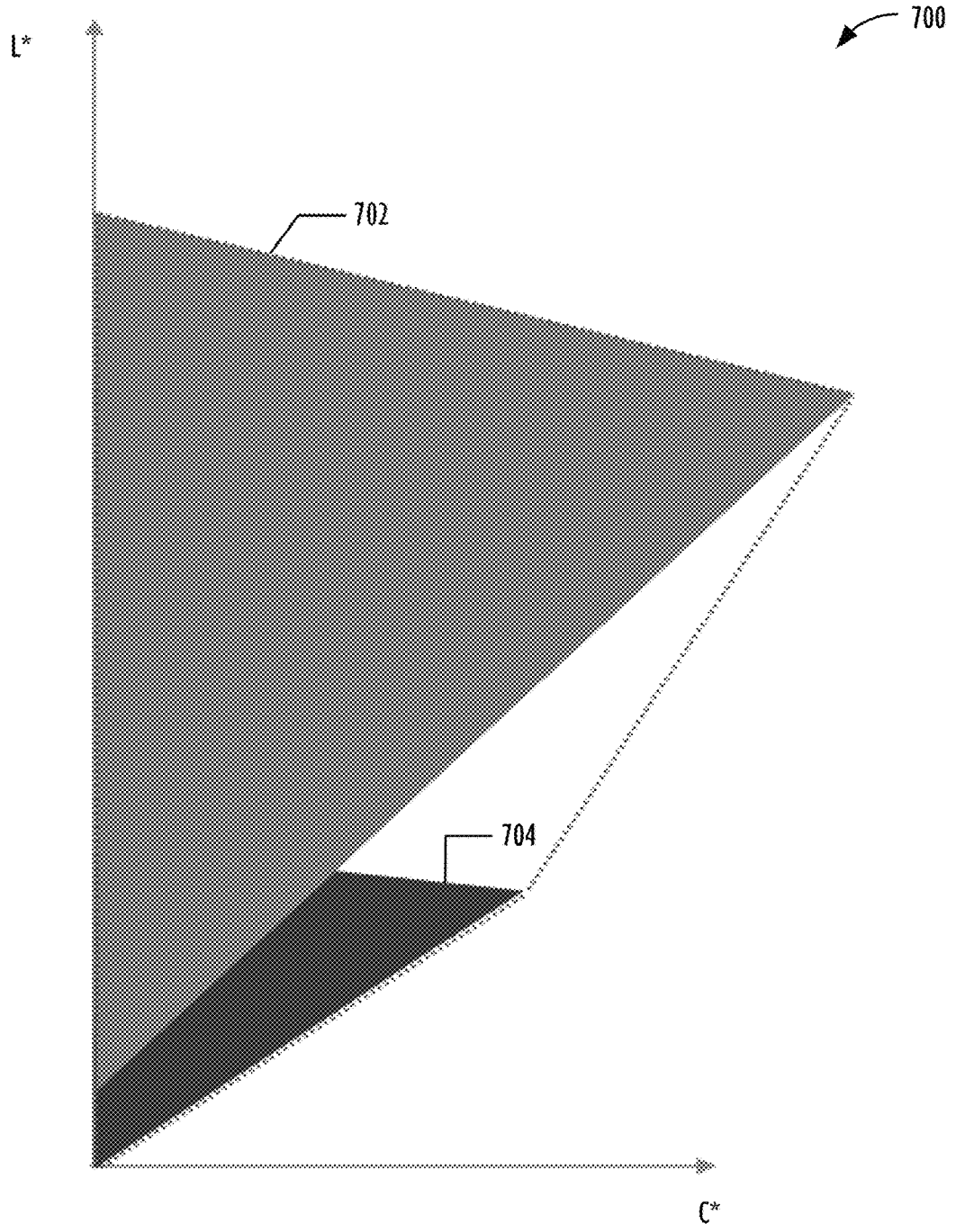
FIG. 7 shows a graphical representation of the additional red color gamut a multi-layer display system is able to obtain by implementing the image splitting operation described in FIG. 6.

FIG. 7 provides a graphical representation 700 of the additional red color gamut a multi-layer display system is able to obtain by implementing the image splitting operation described in FIG. 6. In FIG. 7, section 702 represents the available red color gamut space when minimizing modulation of the monochromatic modulation panel. In other words, the red color gamut space within section 702 corresponds to the gamut space for the modulation of the monochromatic modulation panel and the color modulation panel as shown in graphical representation 400 of FIG. 4. Section 704 represents the additional red gamut space an electronic display device obtains when minimizing the modulation of the color modulation panel as shown in FIG. 6.

Figure 8:
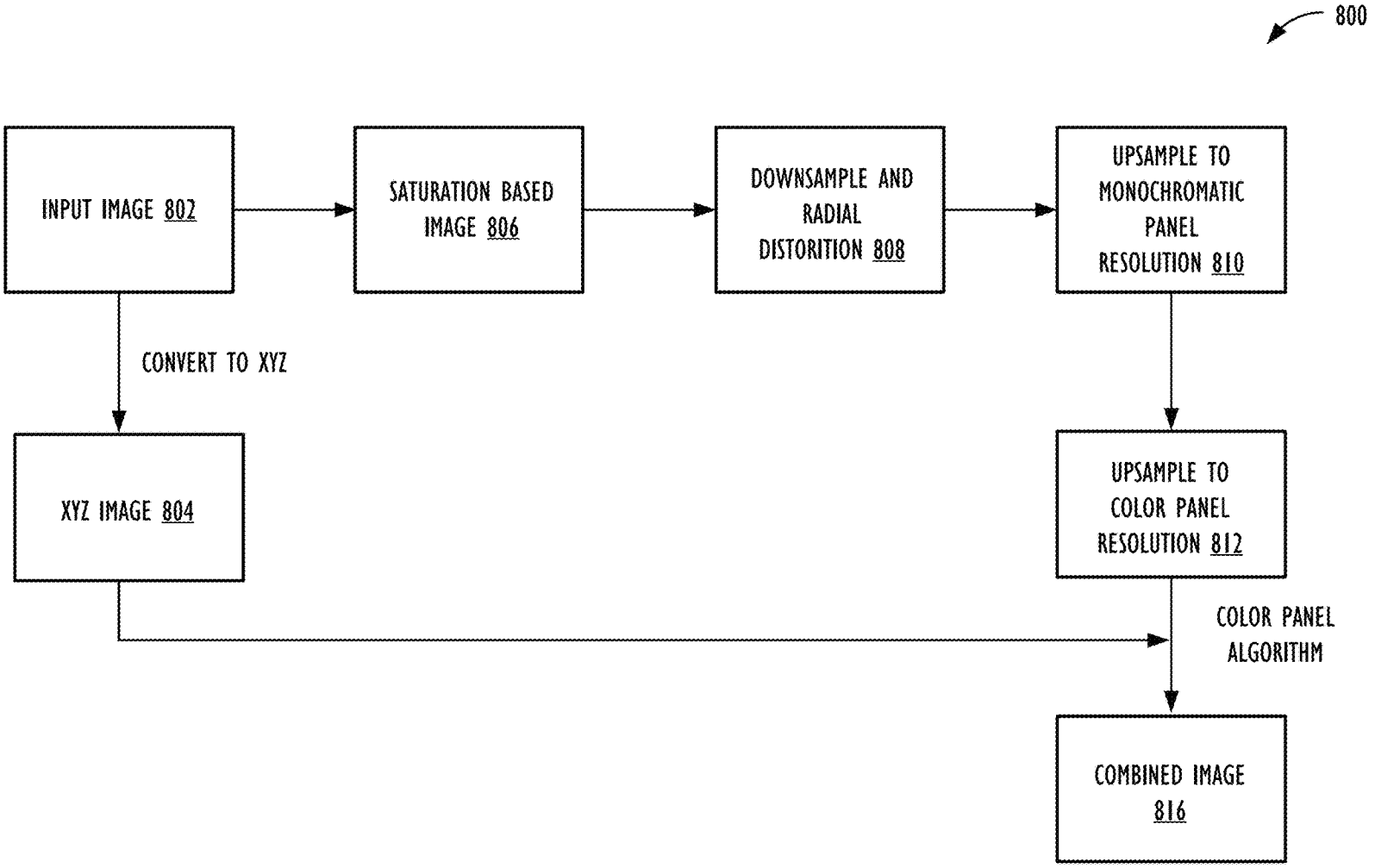
FIG. 8 is a block diagram of the image splitting operation for a multi-layer display system.

FIG. 8 is a block diagram of the image splitting operation 800 for a multi-layer display system. Image splitting operation 800 may receive an input image 802 that could be encoded as an 8 bit RGB image. The input image may be split into two images. The first image may be transformed into XYZ tristimulus values to generate an XYZ image 804. The second image may be modified using the saturation value based implementation as described in block 206 of FIG. 2 to create a saturation based image 806. Afterwards, the image splitting operation 800 performs a downsample and radial distortion 808 on the saturation based image 806. Once completing the downsample and radial distortion 808, the image splitting operation 800 performs and upsample to the monochromatic modulation panel's resolution 810. The image splitting operation 800 may then perform an upsample to the color modulation panel's resolution 812 and then combine the two images to form the color modulation panel image 816. As shown in FIG. 8, the image splitting operation 800 may generate the combined image 816 using a color panel algorithm.

Figure 9:
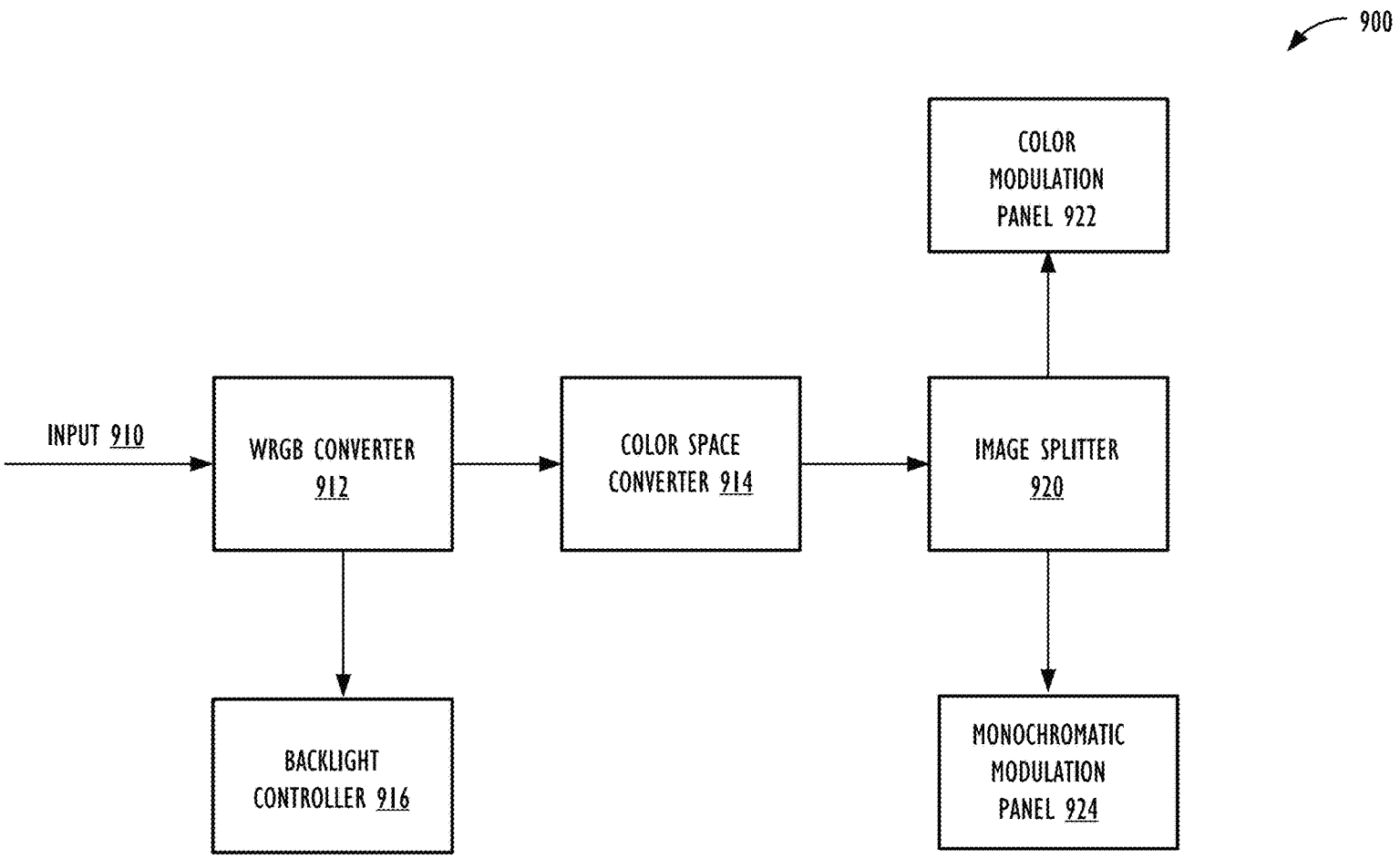
FIG. 9 is a block diagram of an embodiment of multi-layer display device for reproducing digital images.

FIG. 9 is a block diagram of an embodiment of multi-layer display device 900 for reproducing digital images. The different components of the multi-layer display device 900 may be implemented in a display driver circuit (e.g., a timing controller chip), a video card in device, and/or using other types of controller units (e.g., microprocessors, application specific integrated circuits, field-programmable gate arrays, system-on-chip integrated circuits, etc.). The multi-layer display device 900 may transform image data that is encoded in RGB format to image data that is encoded in WRGB format and may perform image splitting operations in which control signals for different aspects of an image to display are allocated between a monochromatic modulation panel and a color modulation panel.

As shown in FIG. 9, image data may be provided to input 910 of the multi-layer display device 900. The multi-layer display device 900 may include a WRGB converter 912 that receives the RGB data on input 910. WRGB converter 912 may determine the brightness setting for a backlight unit from the data supplied to input 910 and supplies a corresponding brightness control signal to backlight controller 916. Backlight controller 916 may adjust the output produced by a light source. WRGB converter 912 maps RGB data to WRGB data. Color space converter 914 converts the WRGB data to an appropriate color space such as the CIE XYZ color space.

Image data can then be split into two channels by image splitter 920. Image splitter 920 may, for example, provide a high resolution color image data component of the image data to color modulation panel 922 while simultaneously providing a low resolution monochromatic localized dimming component of the image data to monochromatic modulation panel 924. The local dimming channel of the image data may be derived from the square of luminance Y in the XYZ color space. The color image data channel of the image data may be formed by dividing the Y channel by the square of Y and using this new Y data with corresponding X and Z data to form the final color image data. When displaying the color component of the image on the color modulation panel 922 and the lower-resolution local dimming component of the image on display stage 924, gamma look-up tables may be used to convert the data from image splitter 920 into WRGB data.

As used herein, the term "dynamic range" of an electronic display refers to the ratio of the highest luminance portion (i.e., brightest portion) of an output of the electronic display and the lowest luminance portion (i.e., darkest portion) of the output of the electronic display.

As used herein, the term "dual-layer" can be interchanged and be generally referred throughout this disclosure as "dual-cell."

Figure 10:
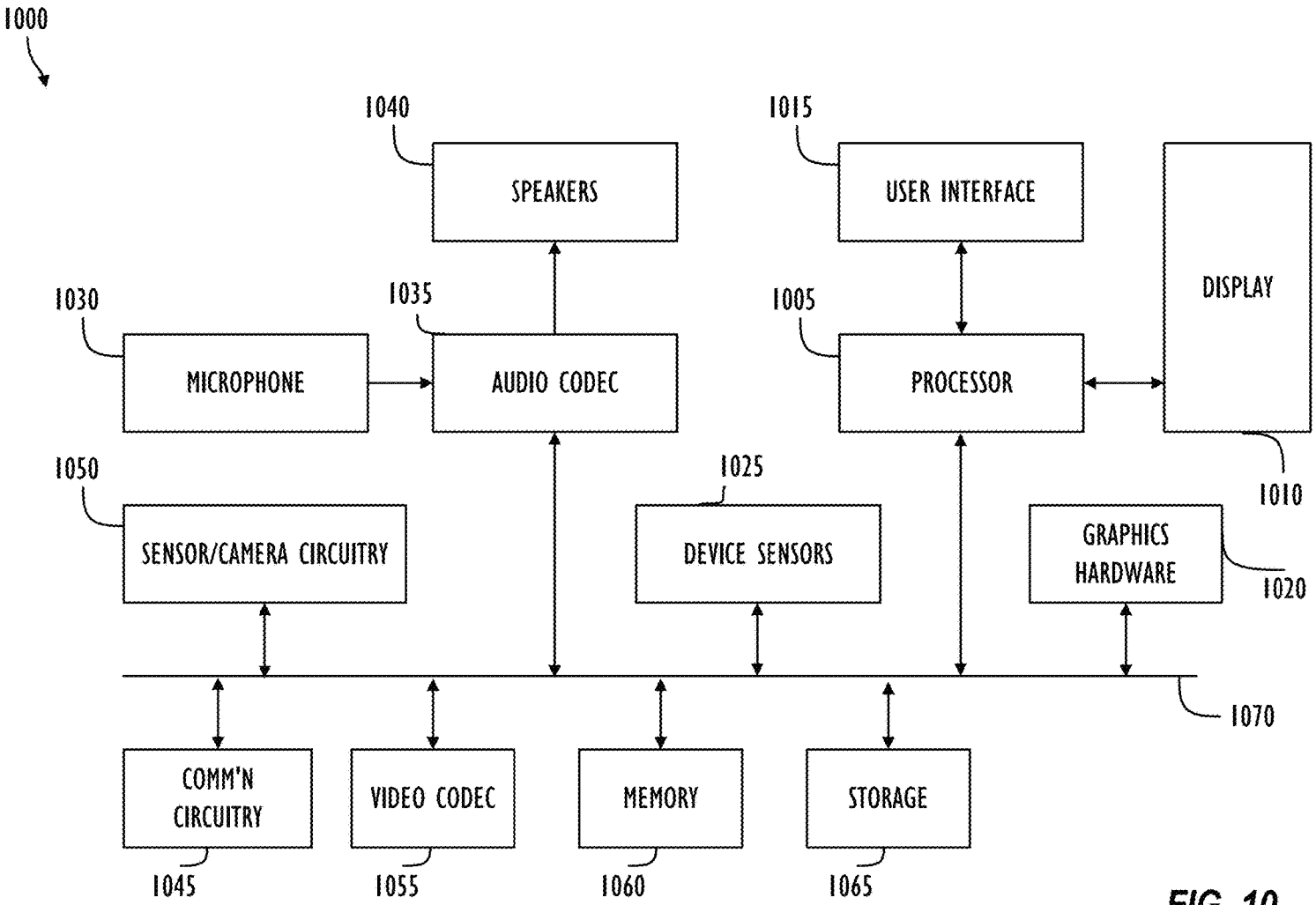
FIG. 10 shows a simplified functional block diagram of an electronic device in accordance with one embodiment.

Referring to FIG. 10, a simplified functional block diagram of illustrative electronic device 1000 that includes the multi-layer display system according to one embodiment as described in FIG. 1. Electronic device 1000 may include processor 1005, display 1010, user interface 1015, graphics hardware 1020, device sensors 1025 (e.g., proximity sensor/ambient light sensor, accelerometer and/or gyroscope), microphone 1030, audio codec(s) 1035, speaker(s) 1040, communications circuitry 1045, digital image capture unit 1050, video codec(s) 1055, memory 1060, storage 1065, and communications bus 1070. Electronic device 1000 may be, for example, a digital camera, a personal digital assistant (PDA), personal music player, mobile telephone, server, notebook, laptop, desktop, or tablet computer. More particularly, the disclosed techniques may be executed on a device that includes some or all of the components of device 1000.

Processor 1005 may execute instructions necessary to carry out or control the operation of many functions performed by device 1000. Processor 1005 may, for instance, drive display 1010 and receive user input from user interface 615. The display 1010 may be a multi-layer display system as described in FIG. 1. User interface 1015 can take a variety of forms, such as a button, keypad, dial, a click wheel, keyboard, display screen, a touch screen, or combinations thereof. Processor 1005 may also, for example, be a system-on-chip such as those found in mobile devices and include a dedicated graphics processing unit (GPU). Processor 1005 may be based on reduced instruction-set computer (RISC) or complex instruction-set computer (CISC) architectures or any other suitable architecture and may include one or more processing cores. Graphics hardware 1020 may be special purpose computational hardware for processing graphics and/or assisting processor 1005 to process graphics information. In one embodiment, graphics hardware 1020 may include a programmable GPU.

Sensor and camera circuitry 1050 may capture still and video images that may be processed, at least in part, in accordance with the disclosed techniques by video codec(s) 1055 and/or processor 1005 and/or graphics hardware 1020, and/or a dedicated image processing unit incorporated within circuitry 1050. Images so captured may be stored in memory 1060 and/or storage 1065. Memory 1060 may include one or more different types of media used by processor 1005 and graphics hardware 1020 to perform device functions. For example, memory 1060 may include memory cache, read-only memory (ROM), and/or random access memory (RAM). Storage 1065 may store media (e.g., audio, image and video files), computer program instructions or software, preference information, device profile information, and any other suitable data. Storage 1065 may include one or more non-transitory storage mediums including, for example, magnetic disks (fixed, floppy, and removable) and tape, optical media such as CD-ROMs and digital video disks (DVDs), and semiconductor memory devices such as Electrically Programmable Read-Only Memory (EPROM), and Electrically Erasable Programmable Read-Only Memory (EEPROM). Memory 1060 and storage 1065 may be used to tangibly retain computer program instructions or code organized into one or more modules and written in any desired computer programming language. When executed by, for example, processor 1005 such computer program code may implement one or more of the operations described herein.

It is to be understood that the above description is intended to be illustrative, and not restrictive. The material has been presented to enable any person skilled in the art to make and use the claimed subject matter as described herein, and is provided in the context of particular embodiments, variations of which will be readily apparent to those skilled in the art (e.g., some of the disclosed embodiments may be used in combination with each other). For example, while FIGS. 1-10 have been described in the context of HDR images, this is not necessary. In addition, some of the described operations may have their individual steps performed in an order different from, or in conjunction with other steps, that presented herein. More generally, if there is hardware support some operations described in conjunction with FIGS. 1-10 may be performed in parallel.

At least one embodiment is disclosed and variations, combinations, and/or modifications of the embodiment(s) and/or features of the embodiment(s) made by a person having ordinary skill in the art are within the scope of the disclosure. Alternative embodiments that result from combining, integrating, and/or omitting features of the embodiment(s) are also within the scope of the disclosure. Where numerical ranges or limitations are expressly stated, such express ranges or limitations may be understood to include iterative ranges or limitations of like magnitude falling within the expressly stated ranges or limitations (e.g., from about 1 to about 10 includes, 2, 3, 4, etc.; greater than 0.10 includes 0.11, 0.12, 0.13, etc.). The use of the term "about" means±10% of the subsequent number, unless otherwise stated.

Many other embodiments will be apparent to those of skill in the art upon reviewing the above description. The scope of the invention therefore should be determined with reference to the appended claims, along with the full scope of equivalents to which such claims are entitled. In the appended claims, the terms "including" and "in which" are used as the plain-English equivalents of the respective terms "comprising" and "wherein."

What is claimed is:

1. A non-transitory program storage device, executable by a programmable control device and comprising instructions stored thereon that when executed cause one or more programmable control devices to:

receive a color input value indicative of a target display color associated with an input image;

determine a color saturation value for the received color input value;

determine a first drive value for a monochromatic modulation panel of a multi-layer display based on the color saturation value;

determine a second drive value for a color modulation panel of the multi-layer display based on the first drive value;

drive the color modulation panel according to the second drive value; and drive the monochromatic modulation panel according to the first drive value, wherein the monochromatic modulation panel is not modulated until the color modulation panel is fully illuminated.

2. The non-transitory program storage device of claim 1, wherein the instructions, when executed, cause the one or more programmable control devices to:

track a view point of a viewer of the multi-layer display; and apply a radial distortion to an image generated by the monochromatic modulation panel based on tracking the view point.

3. The non-transitory program storage device of claim 1, wherein the instructions to cause the one or more programmable control devices to determine a first drive value comprise instructions, when executed, cause the one or more programmable control devices to determine the first drive value according to a linear weighted sum.

4. The non-transitory program storage device of claim 1, wherein the monochromatic modulation panel is configured with a lower resolution than the color modulation panel.

5. The non-transitory program storage device of claim 1, wherein the instructions to cause the one or more programmable control devices to drive the color modulation panel according to the second drive value comprise instructions, when executed, cause the one or more programmable control devices to drive the color modulation panel according to the second drive value in a dark region of the input image.

6. The non-transitory program storage device of claim 1, wherein the color modulation panel is fully illuminated when the target display color corresponds to a bright region of the input image.

7. The non-transitory program storage device of claim 1, wherein an input color gamut size corresponding to an input color region prior to fully illuminating the color modulation panel is smaller than a second input color gamut size corresponding to a second input color region after fully illuminating the color modulation panel.

8. The non-transitory program storage device of claim 1, wherein the instructions to cause the one or more programmable control devices to drive the monochromatic modulation panel comprise instructions, when executed, cause the one or more programmable control devices to drive the monochromatic modulation panel according to the first drive value when the target display color corresponds to a bright region of the input image.

9. A system comprising:

an image display device comprising a back modulation panel coupled to a front modulation panel;

memory; and one or more programmable control devices operable to interact with the image display device and the memory, and to perform operations comprising:

receiving a color input value indicative of a target display color associated with an input image;

determining a color saturation value for the received color input value;

determining a first drive value for the back modulation panel based on the color saturation value;

determining a second drive value for the front modulation panel based on the first drive value;

driving the front modulation panel according to the second drive value; and driving the back modulation panel according to the first drive value, wherein the back modulation panel is not modulated until the front modulation panel is fully illuminated.

10. The system of claim 9, wherein the one or more programmable control devices further performs operations comprising:

tracking a view point of a viewer of the image display device; and applying a radial distortion to an image generated by the back modulation panel based on tracking the view point.

11. The system of claim 9, wherein determining a first drive value further comprises determining the first drive value according to a linear weighted sum.

12. The system of claim 9, wherein the back modulation panel is configured with a lower resolution than the front modulation panel.

13. The system of claim 9, wherein driving the front modulation panel according to the second drive value further comprises driving the front modulation panel according to the second drive value in a dark region of the input image.

14. The system of claim 9, wherein an input color gamut size corresponding to an input color region prior to fully illuminating the front modulation panel is smaller than a second input color gamut size corresponding to a second input color region after fully illuminating the front modulation panel.

15. The system of claim 9, wherein driving the back modulation panel further comprises driving the back modulation panel according to the first drive value when the target display color corresponds to a bright region of the input image.

16. A method comprising:

receiving, by a multi-layer display device, a color input value indicative of a target display color associated with an input image;

determining, using the multi-layer display device, a color saturation value for the received color input value;

determining, using the multi-layer display device, a first drive value for a back modulation panel of the multi-layer display device based on the color saturation value;

determining, using the multi-layer display device, a second drive value for a front modulation panel of the multi-layer display device based on the first drive value;

driving, using the multi-layer display device, the front modulation panel according to the second drive value; and driving, using the multi-layer display device, the back modulation panel according to the first drive value, wherein the back modulation panel is modulated after the front modulation panel is fully illuminated.

17. The method of claim 16, further comprising:

tracking a view point of a viewer of the multi-layer display device; and applying, using the multi-layer display device, a radial distortion to an image generated by the back modulation panel based on tracking the view point.

18. The method of claim 16, wherein determining a first drive value further comprises determining the first drive value according to a linear weighted sum.

19. The method of claim 16, wherein an input color gamut size corresponding to an input color region prior to fully illuminating the front modulation panel is smaller than a second input color gamut size corresponding to a second input color region after fully illuminating the front modulation panel.

20. The method of claim 16, wherein driving the back modulation panel further comprises driving the back modulation panel according to the first drive value when the target display color at least corresponds to a bright region of the input image.

* * * * *